US005259345A

United States Patent [19]

Richeson

[11] Patent Number: 5,259,345

[45] Date of Patent: Nov. 9, 1993

[54] PNEUMATICALLY POWERED ACTUATOR WITH HYDRAULIC LATCHING

[75] Inventor: William E. Richeson, Fort Wayne, Ind.

[73] Assignee: North American Philips Corporation, New York, N.Y.

[21] Appl. No.: 878,644

[22] Filed: May 5, 1992

[51] Int. Cl.[5] ..... F01L 9/02; F15B 15/26

[52] U.S. Cl. ..... 123/90.12; 123/90.14; 91/42; 91/44

[58] Field of Search ..... 123/90.11, 90.12, 90.14; 91/41, 42, 44

[56] References Cited

U.S. PATENT DOCUMENTS

| | | | |
|---|---|---|---|
| 4,843,951 | 7/1989 | Bruggen et al. | 91/42 |
| 4,872,425 | 10/1989 | Richeson et al. | 123/90.14 |
| 4,915,015 | 4/1990 | Richeson et al. | 123/90.14 |
| 4,942,852 | 7/1990 | Richeson et al. | 123/90.14 |
| 5,003,938 | 4/1991 | Erickson et al. | 123/90.14 |
| 5,022,359 | 6/1991 | Erickson et al. | 123/90.14 |
| 5,109,812 | 5/1992 | Erickson et al. | 123/90.14 |
| 5,152,260 | 10/1992 | Erickson et al. | 123/90.14 |
| 5,161,449 | 11/1992 | Everett, Jr. | 91/44 |

FOREIGN PATENT DOCUMENTS

| | | | |
|---|---|---|---|
| 2804771 | 8/1978 | Fed. Rep. of Germany | 123/90.14 |
| 2102065 | 1/1983 | United Kingdom | 124/90.14 |

*Primary Examiner*—Willis R. Wolfe
*Assistant Examiner*—Weilun Lo
*Attorney, Agent, or Firm*—F. B. Faller

[57] ABSTRACT

An axially reciprocable working piston has opposed working surfaces facing opposed working chambers which are intermittently connected to respective cavities pressurized with compressed air. The working piston is connected to opposed seating pistons which cut off the connection between the cavity and working chamber behind the advancing piston and establish the connection in front of the piston, thereby conserving compressed air and storing potential energy for return movement of the piston. In either of two stable positions the working piston is hydraulically latched by fluid admitted to a respective chamber from another chamber through a two-way check valve. The check valve is electronically switched on commend to reverse the flow direction of the hydraulic fluid, thereby initiating movement between opposed stable positions.

18 Claims, 3 Drawing Sheets

PNEUMATICALLY POWERED ACTUATOR WITH HYDRAULIC LATCHING

BACKGROUND OF THE INVENTION

The present invention relates to a bistable straight line motion actuator mechanism of a type suitable for actuating a poppet valve in an internal combustion engine. More particularly, the invention relates to an electronically controlled, pneumatically powered actuator which is hydraulically latched.

An actuator mechanism of the above described type is disclosed in U.S. Pat. No. 5,022,359, which patent is incorporated herein by reference. This patent gives a thorough discussion of prior art actuators, particularly pneumatically powered actuators with energy storage schemes for converting kinetic energy to potential energy using compressed air. Virtually all of the prior art actuators discussed in the patent use some type of magnetic latching for holding the actuator in one of two stable positions.

U.S. Pat. No. 5,022,359 discloses a mechanism which uses a low air pressure (about 10 psi) to hold a working piston in its first stable position (engine valve closed). When a magnetic control valve is electronically switched, high air pressure (about 100 psi) drives the piston toward its second stable position compressing the air in front of it. This motion admits hydraulic fluid to an expansion chamber via a ball check. When the piston reaches its second stable position, the control valve has returned to its initial state, cutting off the air supply, and the compressed air behind the piston is released to atmosphere. The air in front of the piston is fully compressed, but the ball check closes and hydraulic fluid in the expansion chamber prevents motion back toward the first stable position, thereby maintaining the engine valve open. At the conclusion of the valve dwell, an electronically controlled magnetic plunger forces the ball check open, and the compressed air (stored potential energy) forces the piston back toward its first stable position. Air is compressed in front of the moving piston to dampen its motion, but this air is released just as the piston reaches its first stable position.

The actuator mechanism disclosed in U.S. Pat. No. 5,022,359 represents an improvement over the prior art insofar as externally derived propulsion air is used only to open the engine valve, and not to close it. The compressed air consumed is therefore decreased to about half the air consumed in prior pneumatically powered systems. However, two separately controlled magnetic mechanisms, one for the air control valve and one for the plunger to release the ball check, are required. Since the air control valve is rather large, a large electromagnetic latch is required. Further, due to the time required to pressurize the piston with air, after the control valve is switched, the response time is slow and not suited to use at high RPM.

SUMMARY OF THE INVENTION

The present invention provides a fully symmetric actuator mechanism wherein a working piston is pneumatically driven by opposed sources of compressed air in two opposed directions, and hydraulically latched in opposed stable positions by a two position hydraulic latch which is the sole electronically controlled component.

The latch is in effect a two-directional check valve which in each position admits fluid to a respective hydraulic chamber to prevent reverse movement of the working piston. When the check valve is electronically switched, hydraulic fluid passes between the two hydraulic chambers and the latch is released, permitting one of the sources of compressed air to drive the working piston as a working chamber behind the piston expands. As the piston moves, the source of compressed air connected to the expanding working chamber is cut off. Shortly after this, the compressed air expanding in the working chamber is exhausted through ports exposed by the piston. Meanwhile, air is compressed in a working chamber in front of the piston, which working chamber is connected to another source of compressed air in the final stage of movement. This provides damping for the piston without any additional loss of air or air pressure.

The two sources of compressed air are actually just cavities connected to a single source of air which replenishes air lost from an expanding working chamber through the exhaust ports after work is done. The small amount of make-up air is provided when each cavity is connected to its working chamber by action of the advancing piston.

The actuator according to the invention is simpler than the prior art insofar as only one electronically actuated magnetic latch is needed. Since this latch is only moving a low mass valve of the two-way check valve, the magnets are relatively small as compared to most prior art arrangements. Due to the low mass of the check valve, response times are relatively fast.

The two-way check valve provides for a very positive hydraulic latching in both stable positions, and at the same time permits a very fast response. That is, in addition to the low mass, the high pneumatic pressure on the main piston faces in the latched condition provides for a rapid commencement of movement when the check valve is reversed on electronic command.

Due to the compressed air urging the working piston and the slight compressibility of the hydraulic fluid used in latching, the engine valve tends to become slightly unseated when closed. This problem is addressed by a novel cinching arrangement wherein the engine valve is connected to the working piston through spring means which cause it to remain fully seated. More particularly, the valve stem is received through a bore in the working piston and attached to a seating piston in a small pneumatic chamber in the piston. This chamber is connected to high pressure air only when the engine valve is closed, causing it to be fully seated regardless of compression of hydraulic fluid and differential expansion of engine parts. In addition to this pneumatic force there is also a spring in this chamber.

DETAILED DESCRIPTION OF THE PREFERRED EMBODIMENT

Figure 1:
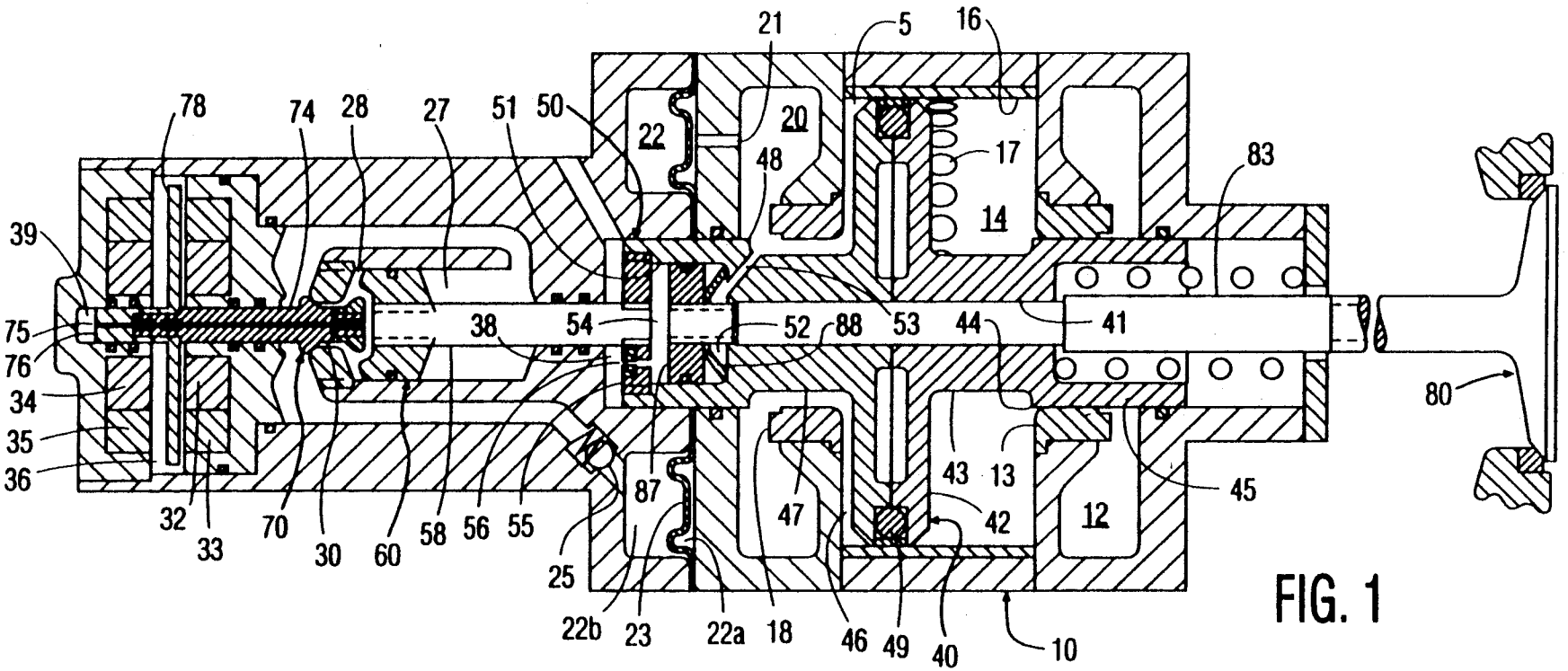
FIG. 1 is a side section view of the actuator in its first stable position (engine valve closed)

Referring to FIG. 1, the basic components of the actuator are the housing 10, pneumatically driven working piston 40, hydraulic latching piston 60, a magnetically driven two way check valve 70 for the hydraulic fluid, and the engine valve 80.

The housing 10 has first and second pneumatic pressure cavities 12, 20 which are connected to a source of high pressure air at 100 psi. In between the cavities 12, 20 are first and second working chambers 14, 15 having a common sleeve 16. As the working piston 40 reciprocates in sleeve 16, the first cavity 12 communicates intermittently with first working chamber 14 and the second cavity 20 communicates intermittently with the second working chamber 15. In the position of FIG. 1, the first cavity 12 is cut off from the first working chamber 14, which is vented to atmosphere by exhaust ports 17. The second cavity 20 is connected to second working chamber 15 so that the piston 40 is pneumatically loaded toward the right. The total volume of the two working chambers 14, 15 is constant.

The second cavity 20 is connected to a make-up chamber 22 by a galley 21; a flexible diaphragm 23 separates the chamber 22 into a pneumatic portion **22*a* and a hydraulic portion 22*b*. A spring and ball type check valve 25 permits hydraulic fluid to pass from chamber portion 22*a* to a first hydraulic chamber 27, but not in the opposite direction. The first hydraulic chamber 27 is separated from a second hydraulic chamber 28 by a port 30 in which the two way check valve 70 reciprocates, and a hydraulic latching piston 60 which is fixed relative to pneumatic piston 40. The volumes of the first and second hydraulic chambers 27, 28 vary as the piston 60** reciprocates, but their total volume remains constant.

The check valve 70 is fixed to a stem 74 which carries an armature disc 78 which is reciprocable in a gap 36 between a first permanent magnet 32 and a second permanent magnet 34. Each magnet 32, 34 is associated with a respective coil 33, 35 which can be energized to induce a magnetic field opposing the associated permanent magnet when it is desired to shift the check valve 70.

Looking at the working piston 40 in greater detail, it has a first working surface 42 facing the first working chamber 14 and spaced from a first sealing piston 45 by a constriction 43 and a shoulder 44. A second working surface 46 facing second working chamber 15 is spaced from a second sealing piston 50 by a second constriction 47 and a second shoulder 48. The sealing pistons 45, 50 pass through respective seals 13, 18 as the working piston 40 reciprocates to effect communication between cavities 12, 20 and respective working chambers 14, 15. A seal 49 on the outer circumference of the piston 40 engages the sleeve 16 to seal the working chambers from each other.

The second sealing piston 50 has an internal bore 51 which is divided into a spring chamber 52 and a vented chamber 54 by a reciprocable seating piston 87. A galley 53 extends between chamber 52 and constriction 47 so that spring chamber 52 will always have the same pneumatic pressure as second working chamber 15. The opposite end of bore 51 is enclosed by a fixed disc 55 having a vent 56 to chamber 38 at atmospheric pressure. A stem 58 fixed at its one end to disc 55, is fixed at its other end to hydraulic piston 60.

The engine valve 80 is integral to a stem 83 which is slideably received through a central bore 41 in working piston 40 and fixed at its other end to seating piston 87. A diaphragm spring 88 in the spring chamber 52 and the pneumatic pressure from galley 53 urge the piston 87 leftward to keep the engine valve 80 against its seat 82.

In the position of FIG. 1, the working piston 40, the hydraulic piston 60, the two way check valve 70, and the engine valve 80 are all in their first stable positions. Pneumatic pressure in the second working chamber 15 urge the working piston 40 toward its second stable position (rightward), but the hydraulic fluid in first hydraulic chamber 27 prevents the hydraulic piston 60 from moving rightward. Since the second working surface 46 of piston 40 is considerably larger than the first surface 62 of the piston 60, the hydraulic pressure in first hydraulic chamber 27 is larger than the pneumatic pressure in chamber 15 by the same ratio as the surface areas. Typically, the hydraulic pressure in chamber 27 reaches 2500 psi against the 100 psi pneumatic pressure. While the hydraulic fluid is slightly compressible, the engine valve 80 remains seated by virtue of the spring force on seating piston 87.

When the desired valve timing dictates opening the engine valve 80, the engine computer causes an electrical pulse to energize the first coil 33, thereby overriding the first permanent magnet 32 and allowing the second permanent magnet 34 to draw the armature 78 leftward. This shifts the check valve 70 in port 30 to the position shown in FIG. 2; the central bore 75 permits the 100 psi hydraulic pressure in second chamber 28 to prevail through the stem 74. However, the pressure in the first hydraulic chamber 27 is considerably greater by virtue of the pneumatic pressure on second surface 46 of the working piston. This pressure differential overrides the magnetic attraction sufficiently to unseat the check valve 70 in port 30 so that the hydraulic pressure tends to equalize in both the first and second hydraulic chambers 27, 28. If it falls below 100 psi, makeup fluid is admitted from chamber 22 by check valve 25.

Figure 2:
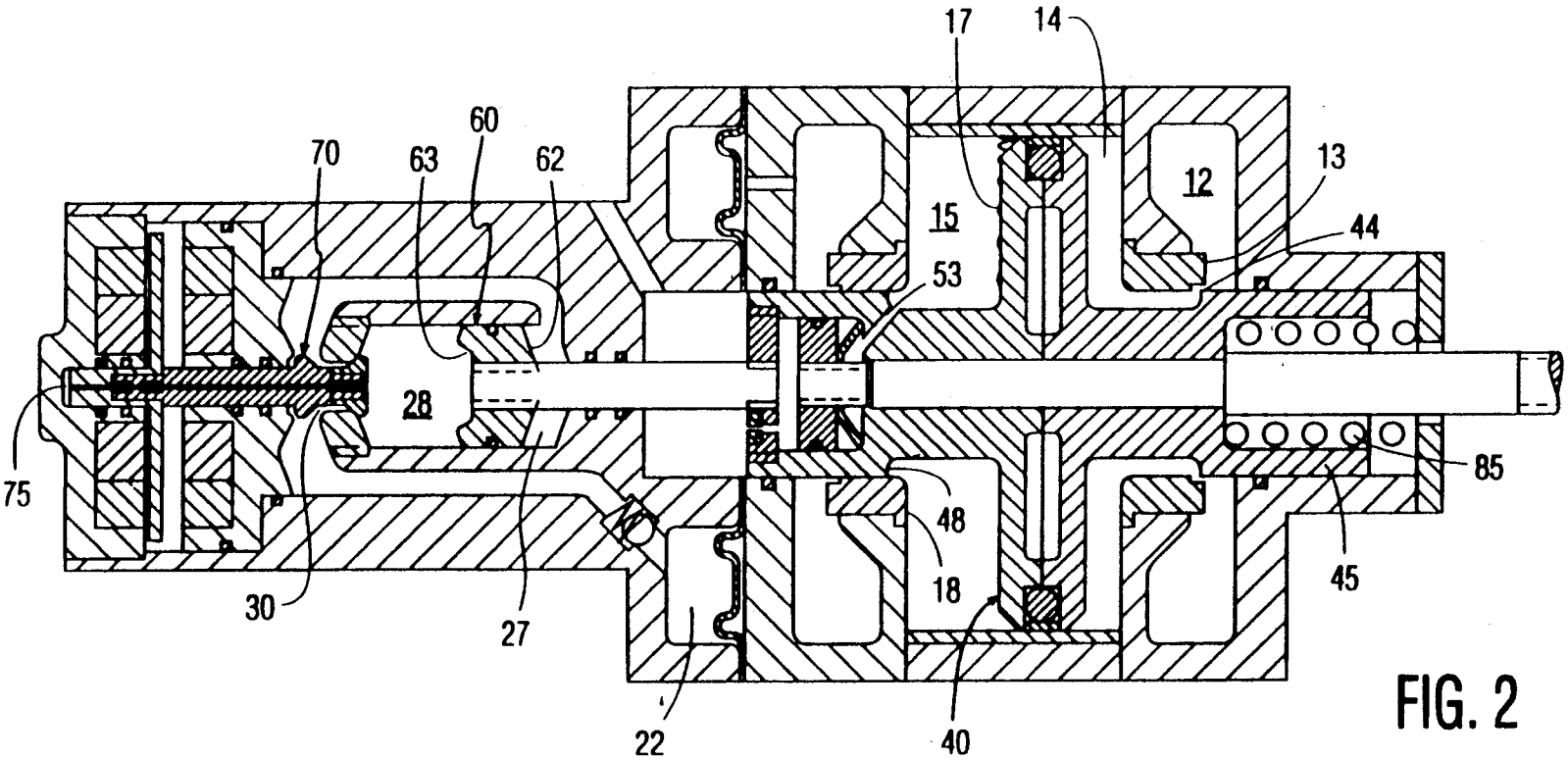
FIG. 2 is a side section view showing the working piston being pneumatically driven toward its second stable position.

Referring still to FIG. 2, the drop in hydraulic pressure against the first surface 62 of piston 60 allows the 100 psi pneumatic pressure in second working chamber 15 to drive working piston 40 toward its second stable position (rightward) thus opening engine valve 80. The second pressure cavity 20 remains in communication with working chamber 15 until the shoulder 48 on second sealing piston 50 enters the second sleeve 18, whereupon the pressure in the second working chamber 15 decreases due to the expanding volume. In the position shown, the piston 40 has just reached the exhaust ports 17 so that ambient pressure prevails in the second working chamber 15. Meanwhile, the pneumatic pressure in first chamber 14 increases, converting the kinetic energy of the working piston into potential energy of the compressed air. In the position shown, the first shoulder 44 has just cleared the first sleeve 13, so that the 100 psi source pressure in first cavity 12 prevails in the first working chamber 14 during the remainder of the piston movement. While 100 psi is greater than the ambient pressure in chamber 15, the momentum of the working piston and the engine valve continues to carry the assembly rightward moving the high pressure air in chamber 14 to chamber 12 as well as compressing the coil spring 85 inside first sealing piston 45. This provides additional damping and storage of potential energy. In a properly balanced system, the source pressure and the spring compression will bring the piston 40 to a halt without any impact.

Figure 3:
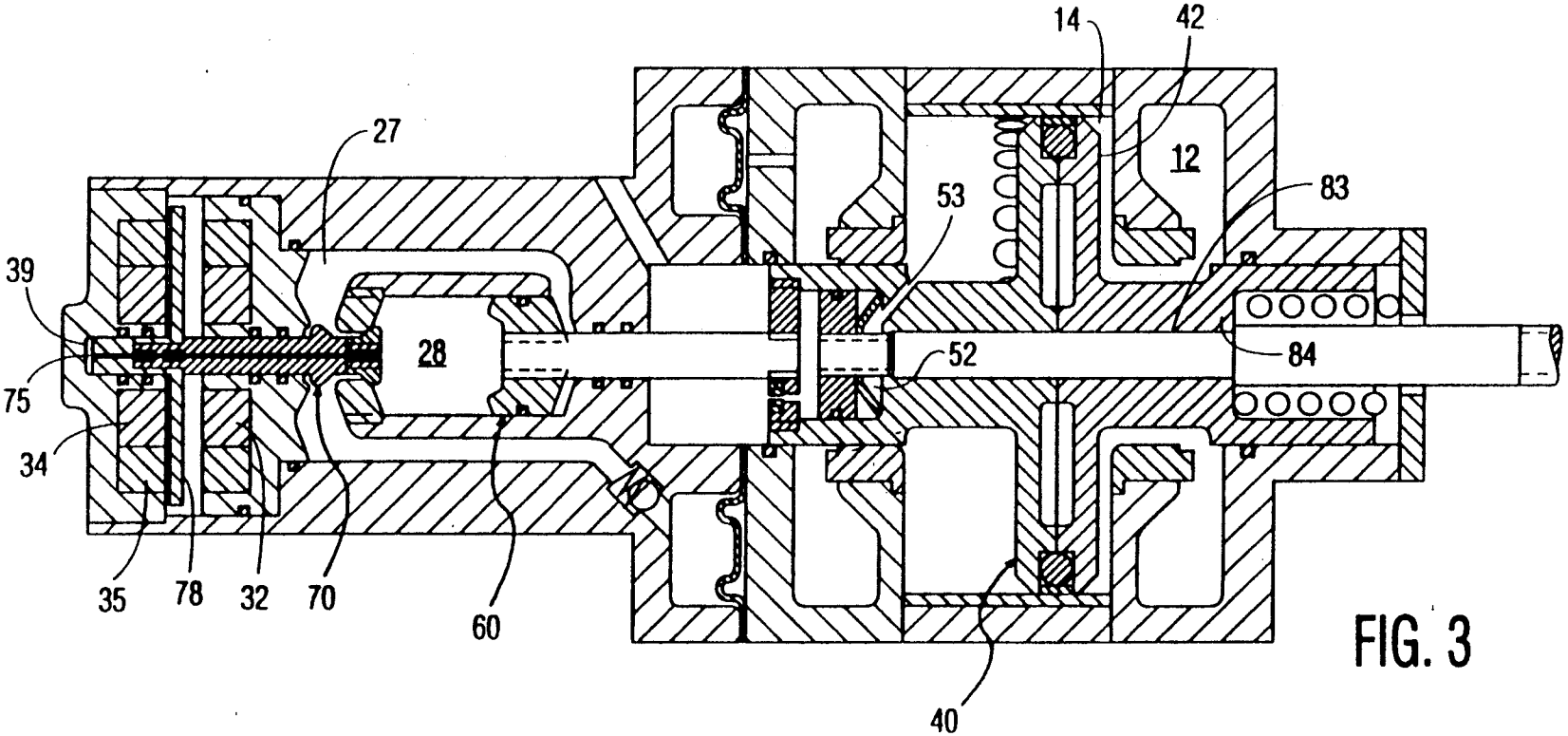
FIG. 3 is a side section view showing the actuator in its second stable position (engine valve open).

In the position of FIG. 3, the working piston 40, the hydraulic piston 60, the two way check valve 70, and the engine valve 80 are all in their second stable positions. The pneumatic pressure in first cavity 12 and first working chamber 14 acts on first working surface 42 to urge the piston 40 toward its first stable position (leftward), and the loaded coil spring 85 compounds this force. However, the hydraulic fluid in the second hydraulic chamber 28 cannot escape through valve 70, and thus acts to latch the engine valve open. Now the pressure in second chamber 28 is considerably higher than that in first chamber 27, e.g. 2500 psi vs. 100 psi, due to the large area of first working surface 42. Note that the pressure in spring chamber 52 is atmospheric by virtue of its connection to second working chamber 15 via galley 53. However, leftward travel of engine valve 80 is prevented by shoulder 84 on stem 83.

The components will remain in the position of FIG. 3 for the dwell period of the engine valve 80, whereupon the engine computer will cause an electrical pulse to energize the second coil 35, thereby overriding the second permanent magnet 34 and allowing the first permanent magnet 32 to draw the armature 78 toward its first stable position (rightward). The hydraulic pressure in second hydraulic chamber 28 is balanced with the pressure on the end 76 by virtue of bore 75, and does not present any impedance to movement.

The foregoing description omits some details which would be apparent to one skilled in the art from an examination of the drawings. For example, the housing 10 has been cast in several sections as would be necessary for machining of internal surfaces and insertion of sleeves and seals. The description is exemplary and not intended to limit the scope of the claims.

I claim:

1. A bistable pneumatically powered actuator mechanism comprising a working piston reciprocable in opposed first and second directions toward respective first and second stable positions, pneumatic means for causing translation of said piston in said opposed first and second directions, and hydraulic latching means for latching said piston in said first stable position against an opposing force provided by said pneumatic means, and for latching said piston in said second stable position against an opposing force provided by said pneumatic means, said latching means comprising a two-way check valve connecting first and second hydraulic chambers which contain hydraulic fluid for latching said piston in respective first and second stable positions, said valve being reciprocable between a first position, wherein hydraulic fluid can flow from said second hydraulic chamber to said first hydraulic chamber but not vice versa, and a second position, wherein hydraulic fluid can flow from said first hydraulic chamber to said second hydraulic chamber but not vice versa.

2. A mechanism as in claim 1 further comprising a make-up reservoir for supplying hydraulic fluid to said hydraulic latching means, and means for pressurizing said make-up reservoir by air pressure from said pneumatic means.

3. A mechanism as in claim 1 further comprising means for causing reciprocation of said two-way check valve between first and second positions on command.

4. A mechanism as in claim 3 wherein said means for causing reciprocation comprises a stem fixed to said valve, an armature fixed to said stem, first and second magnetic means defining an air gap therebetween, said armature being reciprocable on command between said first and second magnetic means.

5. A mechanism as in claim 4 wherein said stem is provided with a bore therethrough for equalizing hydraulic pressure at opposite ends of said stem.

6. A mechanism as in claim 1 wherein said pneumatic means further comprises a first source of compressed air for causing translation of said piston in said first direction, and a second source of compressed air for causing translation of said piston in said second direction.

7. A mechanism as in claim 6 wherein said pneumatic means comprises first working chamber means for compressing air as said piston translates in said second direction, thereby providing damping as said piston approaches said second stable position, and second working chamber means for compressing air as said piston translates in said first direction, thereby providing damping as said piston approaches said first stable position.

8. A mechanism as in claim 7 further comprising means for connecting said first working chamber means to said first source of compressed air as said piston approaches said second stable position, and means for connecting said second working chamber means to said second source of compressed air as said piston approaches said first stable position.

9. A mechanism as in claim 8 wherein said means for connecting said first working chamber means to said first source of compressed air, further serves to isolate said first working chamber means from said first source of compressed air as said piston approaches said first stable position, and said means for connecting said second working chamber means to said second source of compressed air, further serves to isolate said second working chamber means from said second source of compressed air as said piston approaches said second stable position.

10. A mechanism as in claim 8 further comprising exhaust means for exhausting air from said first working chamber means as said working piston approaches said first stable position, and for exhausting air from said second working chamber means as said working piston approaches said second stable position.

11. A mechanism as in claim 6 wherein said working piston has a bore connected to a spring chamber, said mechanism further comprising an engine valve fixed to a stem passing through said bore, said engine valve being closed when said working piston is in said first stable position, a seating piston fixed to said stem in said spring chamber, and means connecting said spring chamber to said second source of compressed air when said working piston is in said first stable position, thereby providing a force on said seating piston for seating said engine valve.

12. A mechanism as in claim 1 further comprising:

an engine valve coupled to said working piston and movable relative to said working piston during operation of the actuator, said engine valve being closed when said working piston is in said first stable position, and means urging said engine valve in said first direction relative to said working piston when said working piston is in said first stable position, thereby providing positive seating for said engine valve.

13. A mechanism as in claim 12 wherein said working piston has a bore connected to a spring chamber, said engine valve being fixed to a stem passing through said bore, said means urging said engine valve in said first direction comprising a seating piston fixed to said stem in said spring chamber and a source of compressed air connected to said spring chamber when said working piston is in said first stable position.

14. A bistable pneumatically powered actuator mechanism comprising a working piston reciprocable in opposed first and second directions toward respective first and second stable positions, pneumatic means for causing translation of said piston in said opposed first and second directions, and hydraulic latching means for latching said piston in said first stable position against an opposing force provided by said pneumatic means, and for latching said piston in said second stable position against an opposing force provided by said pneumatic means, a make-up reservoir for supplying hydraulic fluid to said hydraulic latching means, and means for pressurizing said make-up reservoir by air pressure from said pneumatic means.

15. A bistable pneumatically powered actuator mechanism comprising a working piston reciprocable in opposed first and second directions toward respective first and second stable positions, pneumatic means for causing translation of said piston in said opposed first and second directions, first working chamber means for compressing air as said piston translates in said second direction, thereby providing damping as said piston approaches said second stable position, second working chamber means for compressing air as said piston translates in said first direction, thereby providing damping as said piston approaches said first stable position, an engine valve coupled to said working piston and movable relative to said working piston during operation of the actuator, said engine valve being closed when said working piston is in said first stable position, and means urging said engine valve in said first direction relative to said working piston when said working piston is in said first stable position, thereby providing positive seating for said engine valve.

16. A mechanism as in claim 15 further comprising a first source of compressed air for causing translation of said piston in said first direction, means for connecting said first working chamber means to said first source of compressed air as said piston approaches said second stable position, a second source of compressed air for causing translation of said piston in said second direction, and means for connecting said second working chamber means to said second source of compressed air as said piston approaches said first stable position.

17. A mechanism as in claim 16 wherein said means for connecting said first working chamber means to said first source of compressed air, further serves to isolate said first working chamber means from said first source of compressed air as said piston approaches said first stable position, and said means for connecting said second working chamber means to said second source of compressed air, further serves to isolate said second working chamber means from said second source of compressed air as said piston approaches said second stable position.

18. A mechanism as in claim 16 further comprising exhaust means for exhausting air from said first working chamber means as said working piston approaches said first stable position, and for exhausting air from said second working chamber means as said working piston approaches said second stable position.

* * * * *